US005886664A

United States Patent [19]

Yujiri et al.

[11] Patent Number: 5,886,664

[45] Date of Patent: Mar. 23, 1999

[54] METHOD AND APPARATUS FOR DETECTING MINES USING RADIOMETRY

[75] Inventors: Mikio L. Yujiri, Torrancee; Merit M. Shoucri, Manhattan Beach, both of Calif.

[73] Assignee: TRW Inc., Redondo Beach, Calif.

[21] Appl. No.: 843,587

[22] Filed: Apr. 16, 1997

[51] Int. Cl.[6] ..... G01S 3/02; G01V 3/08; B64D 1/04

[52] U.S. Cl. ..... 342/351; 89/1.13; 89/1.11; 324/326

[58] Field of Search ..... 342/351; 250/339.15, 250/342; 89/1.13, 1.11; 324/326

[56] References Cited

U.S. PATENT DOCUMENTS

| | | | |
|---|---|---|---|
| 3,028,596 | 4/1962 | McGillem et al. . | |
| 3,129,330 | 4/1964 | Seling . | |
| 3,230,532 | 1/1966 | Whitney . | |
| 3,599,207 | 8/1971 | Foiani et al. . | |
| 3,599,211 | 8/1971 | Mardon . | |
| 3,808,596 | 4/1974 | Kazel | 343/100 ME |
| 3,982,125 | 9/1976 | Roder . | |
| 4,521,861 | 6/1985 | Logan et al. | 364/517 |
| 4,641,566 | 2/1987 | Pomeroy . | |
| 4,775,853 | 10/1988 | Borruate . | |
| 4,872,014 | 10/1989 | Nowogrodzki . | |
| 5,012,099 | 4/1991 | Paturel et al. . | |
| 5,121,124 | 6/1992 | Spivey et al. . | |
| 5,160,934 | 11/1992 | Alpers et al. . | |
| 5,202,692 | 4/1993 | Huguenin et al. | 342/179 |
| 5,212,384 | 5/1993 | Fouilloy | 250/334 |
| 5,214,281 | 5/1993 | Rowe . | |
| 5,218,345 | 6/1993 | Muller et al. . | |
| 5,227,800 | 7/1993 | Huguenin et al. . | |
| 5,266,799 | 11/1993 | Steinitz et al. . | |
| 5,286,973 | 2/1994 | Westrom et al. . | |
| 5,365,237 | 11/1994 | Johnson et al. . | |
| 5,445,453 | 8/1995 | Prelat . | |
| 5,452,639 | 9/1995 | Aulenbacher et al. | 89/1.13 |
| 5,471,056 | 11/1995 | Prelat . | |
| 5,638,164 | 6/1997 | Landau | 356/5.01 |
| 5,644,386 | 7/1997 | Jenkins et al. | 356/4.01 |

OTHER PUBLICATIONS

"Passive Millimeter Wave Sensors for Detection of Buried Mines", by Yujiri et al., Detection Technologies for Mines and Minelike Targets, vol. 2496, 1995.

"Detection of Metal and Plastic Mines Using Passive Millimeter Waves", by Yujiri et al., Detection and Remediation Technologies for Mines and Minelike Targets, vol. 2765, 1996.

*Primary Examiner*—Mark Hellner
*Attorney, Agent, or Firm*—Michael S. Yatsko

[57] ABSTRACT

A radiometric data acquisition and display system is provided. The system has a detector assembly with a boom. A radiometer is connected at an end of the boom. The radiometer has a sensor head including an antenna horn to acquire radiometric data from an area of interest. A rangefinder is constructed and arranged to provide location data indicative of a position of the sensor head, and a data processor is connected to receive the location data from the rangefinder and the radiometric data from the radiometer. The data processor includes signal processing circuitry and a display connected to the computer. A method of acquiring and displaying a radiometric image of an object is also provided. The method has the steps of: randomly sweeping a radiometer detector over an area of interest; detecting an object in a portion of the area of interest; sweeping the radiometer detector over the object to acquire radiometric image data; processing the data to construct an image from the radiometric image data; and displaying the image. In an embodiment, the method distributes the radiometric data over an antenna pattern to construct an image using the location data.

33 Claims, 4 Drawing Sheets

METHOD AND APPARATUS FOR DETECTING MINES USING RADIOMETRY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention is directed generally to mine detection and more specifically to a method and apparatus for acquiring and displaying a radiometric image of a mine.

The detection of land mines and other ordnance on the battlefield has grown in importance with their increased use, not only for military personnel, but also for civilians after hostilities have ceased. The need for new approaches and sensors to increase the speed and efficiency of methods to clear mines is an issue that must be addressed.

The detection of land mines has been an important part of battlefield management since the first use of mines. Similarly, the detection of unexploded ordnance (UXO) for clean-up of long-used test ranges is of concern. The importance of both has grown with time and the task has not become easier. The long term danger posed by mines and UXO to both military personnel and displaced civilian populations during wars was illustrated most recently by experiences during the Gulf War and continues today around the world.

As a further example, the dangers posed by metal and plastic land mines is an everyday issue facing the United States military and others in regions such as Bosnia-Herzegovina. Techniques currently being used are relatively crude and labor intensive. The difficulty in locating these and other mines and UXO throughout the world begs the development of improved sensors to speed the process of clearing them to reduce casualties, injuries, and other costs.

Sensors in the millimeter wave region of the electromagnetic spectrum (typically from 30 to 300 GHz) have been shown to be capable of detecting metal above and under dry sand. For example, the inventors of the present application co-authored an article entitled, "Passive millimeter wave sensors for detection of buried mines," SPIE Vol. 2496, April 1995, incorporated in its entirety herein by reference. The detection capabilities disclosed point to new possibilities for improving mine detection techniques. Passive millimeter wave sensors (or radiometers) provide day/night operation, have good spatial resolution, good signal-to-noise ratio (SNR) providing good target contrast, and clutter is benign compared to the situation with ground penetrating (GPEN) radar and infrared (IR) sensors.

For greater ground penetration, extension of the spectrum to lower frequencies is desirable. For example, in the detection of buried mines, lower frequencies have better ground penetration capability and are expected to give improved detection of such targets. The reduced fill factor (discussed below) and lower resolution that follows from the use of lower frequencies forces the use of large apertures or detection at shorter ranges.

Further, it has been shown that metal targets such as mines placed above soil, under an open sky, stand out clearly against the soil background when using a millimeter wave radiometer as an imaging device. There are three basic factors that allow this to happen.

First, the sky above has a very low brightness temperature ($\leqq$40K) which means that it acts like a very cold, low power illuminator that bathes the scene with a very low level of millimeter wave radiation. This occurs at certain spectral windows where emissions from the atmospheric oxygen and water are relatively low (for example, below≈20 Ghz, and around 35, 94, and 140 GHz).

Second, the soil typically has a high emissivity (or low reflectivity), and thus emits millimeter wave radiation corresponding to its physical temperature (≈295K).

Third, the metal target has low emissivity (or high reflectivity). Thus, its own physical temperature is unimportant in terms of its appearance in the millimeter wave regime. The appearance of the metal target is determined by what the target reflects.

These three factors combine as follows: the metal target reflects the low level radiation from the sky and looks like a "cold" object surrounded by the "hot" soil which is emitting a higher level of millimeter wave radiation. This high contrast (295K−40K=255K), combined with typical modem millimeter wave radiometer sensor temperature resolutions of 1K, allows a high signal-to-noise ratio (SNR).

However, the high contrast described above occurs on a clear day, and cloud cover will raise the effective sky temperature, thereby reducing the contrast of the target with its background. A heavy overcast situation can cause the effective sky temperature to rise to about 200K, but this still leaves plenty of contrast.

Similarly, burying the metal target under soil will reduce the target contrast due to the obvious obscuring nature of the soil, but also because of the hot millimeter wave emissions from the overburden. The amount of contrast reduction will vary with the depth of soil coverage, the type of soil, the amount of water content in the soil, and the temperature of the soil.

Another consideration in determining the target contrast in a mine detector system is the "fill factor," a measure of the extent to which the detector's field of view is filled by the reflective target. The smaller the fill factor, the smaller the target contrast. Remote mine detection, as from an airborne platform, requires a sufficiently high resolution sensor to maintain an adequate fill factor.

The effect of the detection frequency on the ability of radiometric techniques to detect buried metal targets has been demonstrated. For example, the inventors of the present application co-authored an article entitled, "Detection of metal and plastic mines using passive millimeter waves," SPIE Vol. 2765, April 1996, incorporated in its entirety herein by reference. Typically the results are plotted as the absolute value of the radiometric temperature difference $|\Delta T|$ between an infinitely thick sand layer and a sand layer of varying thickness over the metal target, versus the thickness of the sand layer. The general trend is that $|\Delta T|$ increases (the sand appears colder than an infinitely thick sand layer) as the sand layer decreases in thickness, until it reaches a maximum value corresponding to the sky temperature directly reflected off the metal target without any obscuring sand. As the sand layer increases in thickness, $|\Delta T|$ approaches zero (the presence of the metal target is totally masked).

The detectability of targets (larger $|\Delta T|$) improves with lower frequencies and lower water content. For a given minimum resolvable temperature that a detector can resolve (based on its noise characteristics) and a given water content, a lower frequency allows detection to a greater depth.

On the other hand, a plastic target, given its much lower reflectivity and its transparency to radiation rising from below it, produces a much smaller $|\Delta T|$ than a metal target. To quantify the degree of detectability of metal and plastic mines using radiometric techniques, measurements have been performed using some typical mines under varying conditions and detection frequencies. The above articles demonstrate that metal and plastic mines can be detected both on the surface and under soil with varying moisture content.

Past detection techniques involve mechanically scanning the scene by passing the radiometer over the scene in a set pattern, and dwelling a long time at each spot to get a good enough integration time, and then forming the image after the fact. Such a technique is an organized, systematic way of generating an image. However, such a process is time-consuming and wasteful. For instance, the radiometer spends an equally long time over areas without a mine, as it does over areas with a mine. Such a system scans the scene back and forth in an orderly manner using a precise system for moving the radiometer back and forth. The radiometer was mounted on an azimuth elevation platform which uses a motorized system with gears and an apparatus to move the radiometer back and forth.

Thus, the radiometer was moved back and forth in a fixed pattern. As the radiometer was moved across the scene, the system recorded the data and its position, but no display was immediately generated. Also, the system did not have the capability for the operator to move the head to an area of interest and scan over that area for a longer period of time.

Thus, the above described detection system operated by scanning to the left, moving forward, scanning to the right, and moving forward again and repeating the process over and over. A raster scan image of the scene was generated showing a two-dimensional image indicating a mine buried under the soil.

The detection of inert metal and plastic mines at the surface or under dry sand or soil, and leaves, has been demonstrated at both 12 and 44 GHz. Soil with a high water content drastically affects the detectability of the mines. Also, modeling predicts that better performance is possible at lower frequencies. A need therefore exists for a method and apparatus for acquiring and displaying a radiometric image of a buried mine which allows an operator to concentrate on a particular region of interest.

BRIEF SUMMARY OF THE INVENTION

A method of acquiring radiometric data for display in the detection of metal and non-metallic mines is provided. The mines may be on top of, or buried under, sand or soil. The method uses passive detection of millimeter wave radiation (for example, at 5 GHz) emanating from the scene of interest, since a relatively lower frequency allows deeper penetration to see things further down in the soil, or into soil that has more moisture in it.

To this end, a mine detection apparatus utilizing radiometric techniques is provided. The apparatus has a relatively low frequency, hand-held or vehiclemounted radiometer which is operated close to the ground to improve fill factor and spatial resolution. Such a device can be used as a stand-alone sensor or used simultaneously with other hand-held or vehicle-mounted mine detectors to reduce false-alarms and to improve identification of targets through the imaging ability of radiometric techniques.

The present invention comprises a radiometer with an input antenna, such as a circular horn, in a sensor head supported by a platform such as a hand-held boom, a ground vehicle, or aircraft, possibly in conjunction with other detectors, with position indicators for the sensor heads, used to generate a two-dimensional map of the potential minefield. The following description is directed to a hand-held configuration in which the region of interest is immediately in front of the operator.

A method of generating an image map is also provided. In an embodiment, the signal processing of the radiometric data gathered by the detector preferably distributes the signal across a "kernel" representing the antenna pattern. A kernel is an image processing term used to describe an array of numbers that are used to process image data.

At each sampling time, a kernel is used to distribute the signal in a normalized manner across a cartesian grid representing the scene, at the location determined by the position indicators. The rotation of the sensor head is irrelevant since the pattern is circularly symmetric.

At the next sampling time, a new kernel is generated. At the new position (which could actually still be at the same coordinates if the sensor head has not moved) the kernel is again used to distribute the signal, and where data already exists (this is kept track of using a counter for each cartesian grid location) an averaging can be performed to improve the statistics of the sampling at that grid location. This process is repeated until the operator has scanned the required area and the operator is satisfied that the image quality is good enough to reveal any mines or other UXO.

DETAILED DESCRIPTION OF THE INVENTION

Figure 1:
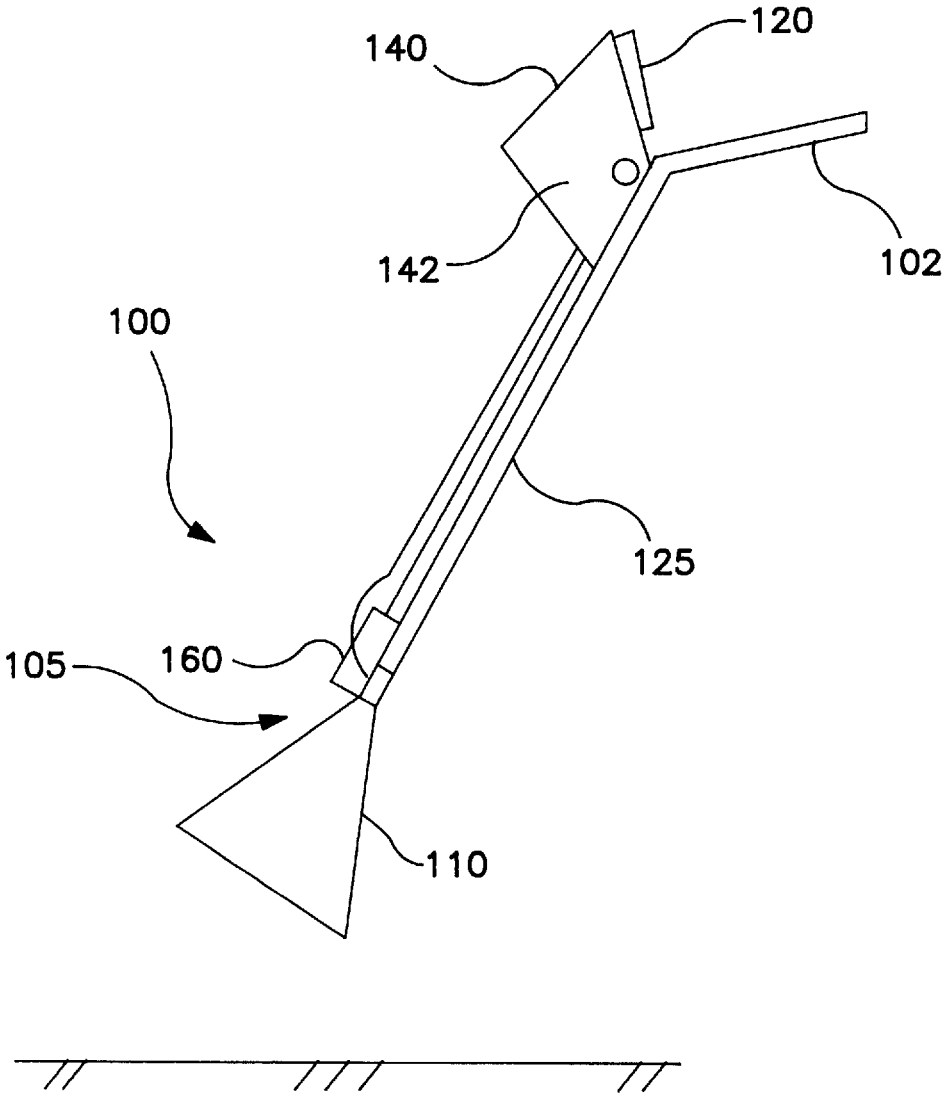
FIG. 1 is an embodiment of a mine detecting system of the present invention in an environment of use.

As set forth above, microwave and millimeter wave radiometers have been shown to be effective at detecting radiometric temperature contrasts between both metal and plastic mines (buried or on the surface) and the surrounding soil. Such radiometers can be built in a very compact and low power form when MMIC low noise amplifiers are used.

The present invention comprises a radiometer with an input antenna, such as a circular horn, in a sensor head supported by a platform such as a hand-held boom, a ground vehicle, or aircraft, possibly in conjunction with other detectors, used to generate a 2-dimensional map of the potential minefield. The following description is directed to a hand-held configuration in which the region of interest is immediately in front of the operator. The method of generating the image map is also described.

In an embodiment, a radiometer having an input antenna, for example, a circular horn, is supported by a platform. The platform is, for example, a hand-held boom, a ground-based vehicle or an aircraft. The radiometer is positioned for detecting objects such as mines, and the output of the radiometer is sampled at fixed time intervals. The corresponding location of the sensor head is also taken at each sample and then those two groups of data, radiometer data and location data, are combined to generate a display of the mine on a monitor screen.

In a typical operation, the operator scans an area of interest until something is detected. An audio cue may be provided, indicating that something is present, thereby alerting the operator to more attentively watch the screen. The operator concentrates on looking at a specific area of interest having an object, or at least what appears to be one. The operator sweeps over that specific area repeatedly in a more refined coverage pattern, which is also more exacting since it is just over the potential object. While the operator acquires radiometer signals, the location of the sensor head is simultaneously detected. There are several ways to determine the location. For example, differential GPS or acoustic or IR-based range finders can be used. The present radiometric detection system also has signal processing and an image display described below.

Thus, the system enables initial mine detection in an area in general and allows the operator to pinpoint the specific location of an object within that area. This further allows the operator to then repeatedly sweep over the object to generate a higher SNR and to refine the image with multiple passes.

Thus, a distinct advantage and difference of the present system is that it allows the freedom to move the sensor anywhere the user desires while recording the x-y position or coordinates of the sensor head, and in a real-time manner, allows the user to see how the image is being created and provides the option of concentrating the scanning in areas of interest, thereby increasing the integration time only where needed, as opposed to integrating over the entire area.

A related advantage of such a system is that dwelling over a certain area averages the current signal with earlier readings at that same location. The data is accumulated, thereby increasing the integration time to obtain a better signal-to-noise ratio.

Referring now to the figures, FIG. 1 illustrates an embodiment of a radiometric data acquisition and display system of the present invention. The embodiment illustrated is a hand-held mine detector system indicated generally at 100. In most instances, an operator is most interested in scanning the area immediately in front (usually within boundaries defining a marked lane to be searched). To this end, the operator preferably carries the detector out in front using handles 102 or the like. A sensor head 105 of the detector 100 comprising an antenna 110 is arranged in the front and is counterweighted in the back to provide a balanced apparatus for ease of use over long periods.

Additionally, a display 120 is mounted on a boom 125. The display 120 is preferably a small, liquid crystal display or backlit display screen capable of producing a bright enough image to be readily seen outdoors in broad daylight when the apparatus is likely to be used. Other system information may also be displayed on the screen 120. A vehicle-mounted system could support a larger display since it is most likely mounted inside the vehicle. The display can also be chest mounted or on a helmet. The detector system 100 also includes a computer or microprocessor 140 and associated hardware 142 and/or software for performing signal processing on the data acquired to generate a display indicative of the mine. The signal processing is described further below.

Figure 2:
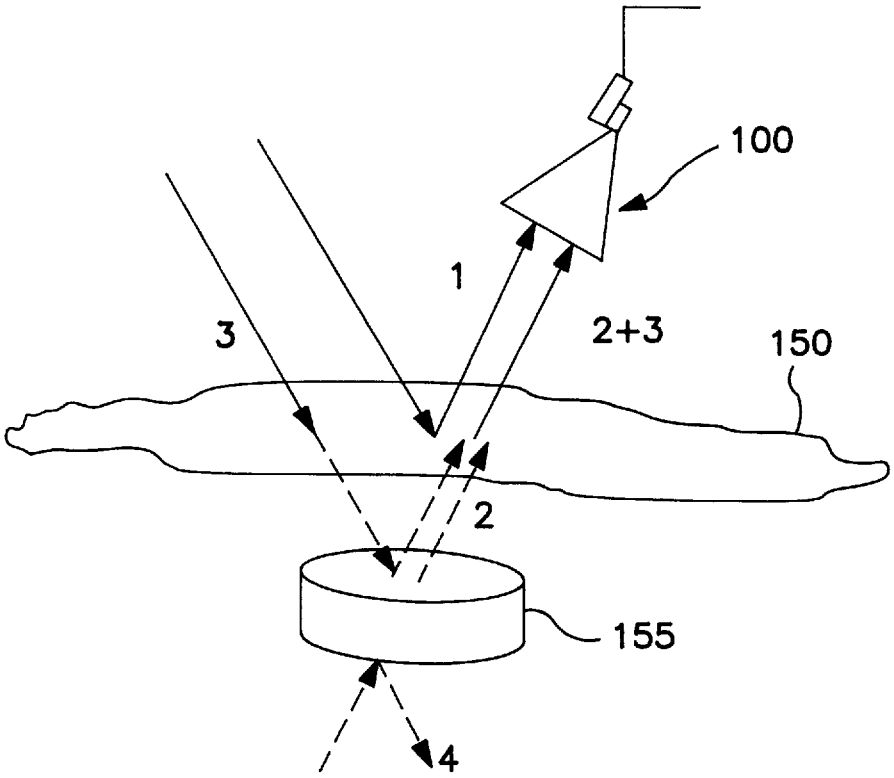
FIG. 2 is an embodiment of a mine detecting system of the present invention in an environment of use with a mine present.

FIG. 2 illustrates an embodiment of the mine detection system 100 using microwave or millimeter wave radiometry to detect a buried mine. In FIG. 2, the radiometer detector 100 is arranged above a ground surface 150 and a mine 155 buried beneath the surface 150. Rays indicating the electromagnetic waves at the appropriate detection frequencies are shown in FIG. 2. The rays indicate radiometric signal contributions to the detector 100, and include reflections from the ground surface indicated by ray 1, as well as emissions from the soil above the mine indicated at ray 2, and radiation from the sky passing through the soil and reflecting off of the mine 155 indicated by ray 3. Radiation from under the mine 155 is blocked by the mine 155 and subsequently prevented from reaching the detector 100 as indicated by ray 4.

Figure 3A:
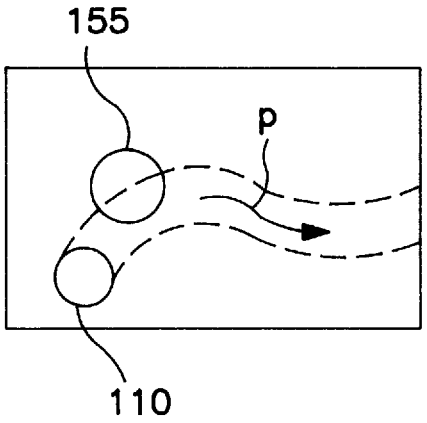
FIG. 3A is a schematic diagram illustrating a mine and a radiometer detection zone.
Figure 3B:
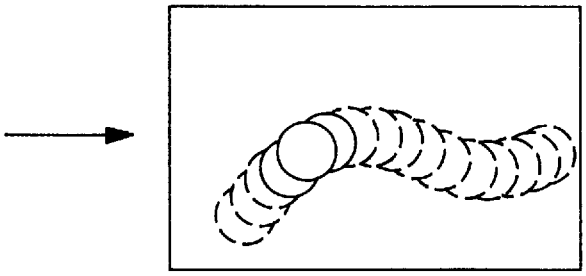
FIG. 3B is a schematic diagram illustrating a resultant image on a monitor in the system of the present invention.
Figure 3C:
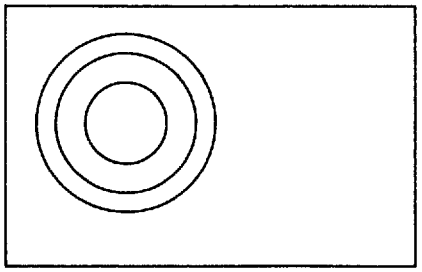
FIG. 3C is a schematic diagram illustrating a final image on a monitor in the system of the present invention.

FIG. 3A is a schematic diagram illustrating a mine and a radiometer detection zone. As illustrated in FIG. 3A, the movement of the radiometer antenna 110 creates a swath in a direction indicated by arrow P which partially passes over the mine 155. As the radiometer is moved in the manner indicated in FIG. 3A, a resultant image on the monitor corresponding to the radiometric data acquired illustrates partial detection of the mine. This is illustrated in FIG. 3B by the varying levels of gray scale, in which lighter levels are displayed in the swath of the radiometer away from the mine, and darker levels are displayed when the radiometer passes nearer to and over a portion of the mine. This visual indication allows the operator to hone in on the darker areas and sweep over them repeatedly to generate a final image as illustrated in FIG. 3C.

Using an apparatus described above with reference to FIG. 1, a radiometer output is sampled at fixed time intervals, and at each sampling time, the location of the sensor head 105 is determined and noted. As the operator moves the sensor head 105 across the scene of interest, data is collected (the radiometer signal data and the two-dimensional coordinates indicative of the sensor head location).

The location of the sensor head 105 can be determined relative to the operator's feet. Several methods can be employed to determine the sensor head location, ranging from somewhat sophisticated techniques using differential GPS to relatively simple acoustic or IR-based rangefinders 160 mounted on the sensor head 105 that monitor the distance to each of the operator's feet.

As shown in FIGS. 1 and 2, the sensor head 105 scans the ground as a spot. The detection zone of the radiometer is typically a circle about six inches in diameter. The horn 110 is about 10 inches off the ground surface. The antenna horn 110 may be angled at approximately 20° from vertical to look slightly forward. The soil and whatever objects may be present emanate radiation into the antenna 110 thereby into the antenna generating the radiometric data levels.

A millimeter wave or a microwave horn has what is called an antenna pattern characteristic of that horn. The sensitivity of the horn varies as a function of position and is generally symmetric. A round horn generates a pattern on the ground that is circularly symmetric (or elliptical, if the horn is oriented at an angle with respect to the ground). Such a horn antenna is more sensitive near its center. The antenna pattern can be measured and modeled by the computer as a two-dimensional array of numbers that represents the sensitivity distribution for that antenna pattern.

The signal processing and image display uses a novel technique best described as a paintbrush-type technique. As the operator swings the sensor head over the ground, an image is painted on the display monitor screen in a manner reminiscent of a paintbrush passing over the screen. To improve the quality of the image (by generating a greater signal-to-noise ratio), the operator simply passes the sensor head over the same area repeatedly to increase the total integration time over that area.

Turning now to a description of the method of acquiring radiometric and location data for signal processing and image generation in the system described above, the radiometer detector system 100 incorporates known radiometric techniques using the horn 110 and associated electronics 142 for detecting the millimeter wave or microwave radiation. The electronics 142 converts detected radiometric input signals into what may be termed a basically DC signal, since the signal is low when there is not much power coming in and high when there is more power coming in. The DC signal can be amplified, filtered, or processed using standard analog signal processing. Amplification and noise filtering are typical operations to be performed. An amplified and filtered signal is an input to the computer 140 which includes an analog-to-digital (A/D) converter for digitizing the signal.

Similarly, another channel is connected as an input to the computer 140. This channel has location information including, for example, x and y coordinates of the sensor head 105 of the detector 100. The position information is processed within the computer 140 so that it corresponds to the radiometric data for generating the display.

A simple way of plotting the results involves the operator pointing the antenna 110 at a particular x and y position on the ground and displaying an image on the computer screen 120 at a corresponding x and y position. A color or a gray level represents the amplitude of the signal. When the horn 110 is moved to another position and a measurement is taken there, a new level value associated with that point is displayed as a single point on the screen. This can be done across the whole field of view to generate a two-dimensional image; all that is done is plotting single points representing the signal without taking into account the pattern of the antenna 110 at all.

A level of improvement in the display results from aiming the antenna 110 at one point on the ground to obtain a reference-type signal. The screen 120 would not display a single point, but instead would display a circular pattern of points whose distribution is set by the antenna pattern, typically stronger in the center and weaker toward the edges as discussed above.

Another approach for acquiring and processing radiometric and location data is to survey a certain area in front of the operator, for example, a plot of ground three feet wide and two feet deep ("deep" meaning away from the operator). The area is divided up into little bins, for example, one inch by one inch, to create 36 bins across and 24 bins deep. An array is defined in the computer 140 corresponding to each of the bins. There are at least three ways of handling the signal at this point.

Figure 4A:
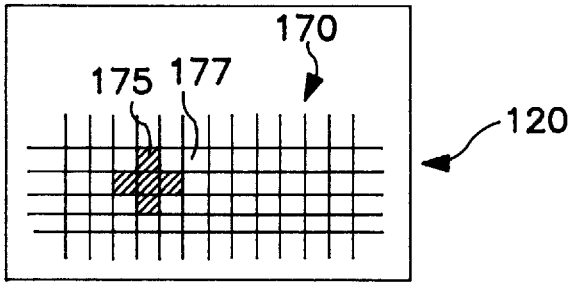
FIG. 4A is a schematic diagram of a display of a radiometric image illustrating a first method of signal processing of the present invention.

FIG. 4A illustrates a first, relatively simple method to process the radiometric and location data. This method includes the steps of digitizing the data, using the location coordinates, and entering a number that corresponds to the signal level that you just digitized at the corresponding bin or bins in the array. When a bin that has already received a data entry is encountered a subsequent time, a counter increments and the prior data entry and the new data entry are added together and averaged. While the detector 100 is acquiring readings, the computer 140 can simultaneously be processing and displaying the corresponding data values on the computer screen 120 in a picture format. That is, the computer 140 assigns a number or a range of numbers corresponding to the radiometric data values to a certain gray scale level or color. For example, a relatively small number is assigned a black level, and a relatively high number has a white color assigned to it, with all the shades of gray or colors being distributed in between the two limits.

Thus, as shown in FIG. 4A, an imaginary grid 170 on the screen 120 is populated with little blocks of color 175, grays or blacks and whites 177. Over time the screen 120 is filled up with colors or levels of gray that form an image. However, doing so is quite tedious because every spot must be covered. Coupled with the fact that in the example, one inch squares are being used, and that the sensor must be held very steadily over the grid, the process can be aggravating and time-consuming to an operator in an already stressful situation performing a dangerous task. This first technique is essentially painting one bin at a time with a small brush.

Figure 4B:
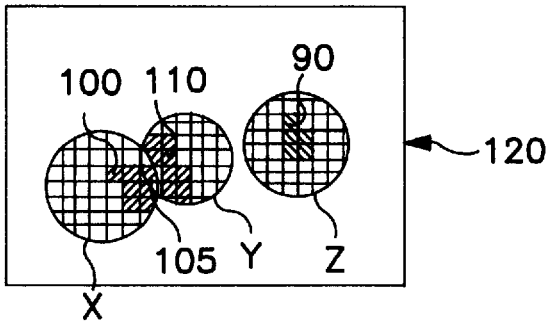
FIG. 4B is a schematic diagram of a display of a radiometric image illustrating a sect method of signal processing of the present invention.

FIG. 4B illustrates a second technique of processing the radiometric and location data to generate an image. This method involves utilizing the larger circular or slightly elliptical spot cast by the antenna 110 on the ground surface. This provides an improvement over the first technique by effectively using a bigger paintbrush to more quickly cover more area. In particular, the "painting" of one inch squares is replaced with painting using a brush with an area of approximately 30 square inches ($\pi r^2$, where r is a radius of three inches, as set forth above); an approximately 30-to-1 improvement.

Thus, in this second technique, a certain signal level, for example 100, is received from the A/D of the computer 140 at a given position. A level of 100 is distributed to each bin that is within the six inch diameter circle. A relatively smooth, digitized circle, a pixelized circle is generated. As shown in FIG. 4B, circle X is illustrated with a crosshatch indicating a level of 100 in each bin within the circle.

The number 100 is in each of the bins, approximately 30 bins within the six inch diameter circle. At the next position, the system digitizes another signal and locates the position the center of the circle, for point of reference. At that new position, the new signal level is entered in each of the bins that falls within that six inch circle or ellipse. For example, as shown in circle Y of FIG. 4B, a crosshatch indicating a level of 110 is illustrated. Invariably there will be some overlap with the earlier circle of numbers recorded, so an averaging on a bin by bin basis is performed. Thus, an overlap area between circle X and circle Y is shown with an averaged level of 105 (the average of 100 and 110). Circle Z is shown with a level of 90, indicated by the crosshatch in each bin encircled by circle Z.

This method offers the advantage of sweeping the whole scene, but not worrying about hitting every little bin, because the brush is very broad, for example 30 times broader in coverage. The operator can sweep around a specific area of interest more quickly to obtain the image, or at least some indication that there is an object of interest. The operator can go back and scan a specific area having a potential object and sweep the area or "paint" around that object to increase the integration time for a better signal-to-noise ratio.

The inventors also recognize making a provision for changing the effective size of the "paintbrush." For example, placing optics in front of the horn, or changing the shape of the horn to change the imaging footprint is possible. This may be desirable to obtain a sharper image, if an object is relatively small. Decreasing the spot size may also enhance determining the shape of an object. There are mechanical ways of doing this known to one having ordinary skill in the art. Also, electronic focusing methods are possible.

The third method of processing the radiometer and location data to generate an image involves using the antenna pattern represented by the kernel discussed above. The computer 140 has a program in which the kernel is a distribution of numbers corresponding to the antenna pattern. Assuming an input signal of 100 units, the kernel is used to distribute the 100 units. In the center, for example, may be 10 units, and around that is a ring of 9 units, and then 8 units and so forth, all the way down to 0 units. Thus, the distribution of the kernel corresponds to the horn antenna pattern, basically a map of sensitivity of the horn versus angular position, which is a measurable quantity. It is fixed by the geometry of the horn. Using this antenna pattern kernel refines the image.

Figure 4C:
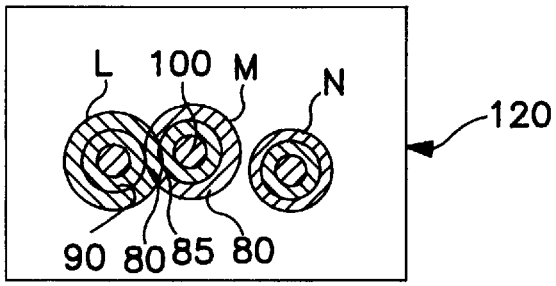
FIG. 4C is a schematic diagram of a display of a radiometric image illustrating a third method of signal processing of the present invention.

A description of the image data distribution using an extremely simple kernel is as follows. For example, considering the kernel as a three-by-three array of numbers, the kernel is defined so that the center point corresponds to unity (one), and the surrounding eight points are defined to have a value of 0.5. Thus, if the radiometer receives a signal of 100 power units, the distribution over the nine positions of the three-by-three kernel is proportional to the kernel described above. Namely, divide the 100 units proportionately so that 20 units are in the center and 10 on each of the other positions. The sum of all image data points adds up 100, the total signal. As a result, the distribution of 20 units in the middle and 10 units in the eight surrounding positions is displayed on the monitor or screen 120. A particular number of units, namely 20, might represent a particular color or gray scale value and the 10 would be a different color or gray scale value. Thus, the screen displays a relatively bright spot in the middle surrounded by eight slightly darker spots. With successive passes over the same areas, accounting for the overlap is necessary as discussed above in the second method. The repeated passes and averaging of the signal levels increases the SNR and resolution of the image as illustrated in the FIG. 4C. For example, FIG. 4C shows three kernels, L,M,N each having concentric level rings of different colors illustrated by the crosshatching. The center area has for example a level of 100. An intermediate level has a lesser radiometric reading of 90, and an outer ring has a level of 80, for example. The overlap areas between kernels L and M have the overlapping levels averaged, for example a level of 85.

An additional advantage of the present invention is the feature of color or gray scale selection described as follows. Initially, the computer doesn't really know what gray value to assign to any specific number, so after about 10 seconds of panning the radiometer across the ground, the system pauses to add up all the numbers in all the bins. The system then assigns the smallest number to a black color and the highest number to a white color. The range of numbers is thus divided by the levels of gray scale of color in the system.

The image is substantially refreshed so that a uniformly distributed range of gray or color is provided. The computer is fast enough so that the operator will not even notice the refresh, but simply continues waving the detector 100 around to obtain better looking signals. This refresh occurs at some periodic rate which may be variable, if desired.

Another reason for the refresh feature is that if the radiometer output level is drifting the operator can correct, to some extent, for that drift. If the signal drifts in a DC manner, from low to high over the course of the time of the sweeping, the image will be distorted. So, the stability of the radiometer is fairly important, or at least means to compensate for those drifts that needs to be incorporated.

Although the above embodiment has been described with reference to a hand-held unit, alternate arrangements are also possible. For a different platform configuration, such as on a ground vehicle, the radiometer is mounted to be able to scan the ground from a distance, and the location of the radiometer's detection footprint on the ground is noted instead of the sensor head's location. An airborne platform is also a possible implementation of the invention.

An implementation on a vehicle or an airplane may include a series of radiometers arranged in a line. The radiometers are then pushed along the ground in a pushbroom manner, so to speak, in front of the vehicle to acquire parallel strips of radiometric information.

While particular elements, embodiments and applications of the present invention have been shown and described, it will be understood, of course, that the invention is not limited thereto, since modifications may be made by those skilled in the art, particularly in light of the foregoing teachings. The appended claims are intended to cover such modifications which come within the spirit and scope of the invention.

We claim:

1. A method of acquiring and displaying a radiometric image of an object, the method comprising:

randomly sweeping a radiometer detector over an area of interest;

detecting an object in a portion of the area of interest;

randomly sweeping the radiometer detector over the object to acquire radiometric image data;

processing the data to construct an image from the radiometric image data; and displaying the image.

2. A method of acquiring and displaying a radiometric image of an object, the method comprising:

randomly sweeping a radiometer detector over an area of interest;

sampling an output of the radiometer detector at preselected time intervals to obtain radiometer data;

establishing the location of the radiometer detector at each preselected time interval to obtain location data;

processing the radiometer data and the location data to construct an image; and displaying the image.

3. The method of claim 2, further comprising the step of:

repeatedly sweeping the detector over an object.

4. The method of claim 3, further comprising the step of averaging the radiometric data for the same location data.

5. The method of claim 2, wherein the step of establishing the location of the radiometer detector is performed by using differential GPS techniques.

6. The method of claim 2, wherein the step of establishing the location of the radiometer detector is performed by using an acoustic rangefinder.

7. The method of claim 2, wherein the step of establishing the location of the radiometer detector is performned by using an infrared (IR) rangefinder.

8. The method of claim 2, wherein the step of establishing the location of the radiometer detector is performed by using a spooled string apparatus connected to the radiometer detector and a user.

9. The method of claim 2, wherein the detector includes a sensor horn having an antenna pattern, and wherein the step of processing the data further comprises the step of:

distributing the data across a kernel representing the antenna pattern of the detector.

10. The method of claim 2, wherein the step of processing the data further comprises normalizing the data over a cartesian grid representing the area of interest.

11. A radiometric data acquisition and display system, the system comprising:

a detector assembly having a boom;

a radiometer connected at an end of the boom, the radiometer having a sensor head including an antenna horn to acquire radiometric data from an area of interest;

a rangefinder constructed and arranged to provide location data indicative of a position of the sensor head;

a data processor connected to receive the location data from the rangefinder and the radiometric data from the radiometer, the data processor including signal processing circuitry which samples the location data and the radiometric data at preselected time intervals; and a display connected to the data processor on which an image corresponding to the acquired radiometric data is displaved using a paintbrush technique.

12. The system of claim 11, further comprising:

a portable, hand-held detector assembly.

13. The system of claim 11, further comprising:

an acoustic rangefinder.

14. The system of claim 11, further comprising:

an IR-based rangefinder.

15. The system of claim 11, further comprising:

a differential GPS-based rangefinder.

16. The system of claim 11, wherein the antenna horn has a symmetric antenna pattern.

17. The system of claim 16, wherein the antenna horn has a maximum sensitivity at its center, the sensitivity decreasing radially outwardly from the center.

18. A method of acquiring and displaying a radiometric image of an object, the method comprising:

randomly sweeping a radiometer detector over an area of interest, the radiometer detector having an antenna pattern;

sampling an output of the radiometer detector at preselected time intervals to obtain radiometric data;

establishing the location of the radiometer detector at each preselected time interval to obtain corresponding location data;

defining a kernel representing the antenna pattern;

distributing the radiometric data in accordance with the kernel and the location data to construct an image; and displaying the image.

19. The method of claim 18, further comprising the steps of:

providing a plurality of colors, ranging from a darkest color to a lightest color, for displaying the image;

assigning the darkest color to a minimum radiometric data reading;

assigning the lightest color to a maximum radiometric data reading; and distributing the remaining colors of the plurality of colors to radiometric data between the minimum and the maximum readings.

20. The method of claim 19, further comprising the step of:

repeating the assigning and distributing steps at regular intervals to refresh the display.

21. A method of acquiring and displaying a radiometric image of an object, the method comprising:

randomly sweeping a radiometer detector over an area of interest, the radiometer detector having an antenna pattern;

sampling an output of the radiometer detector at preselected time intervals to obtain radiometric data;

establishing the location of the radiometer detector at each preselected time interval to obtain corresponding location data;

distributing the radiometric data equally over the antenna pattern to construct an image using the location data; and displaying the image.

22. The method of claim 21, further comprising the steps of:

sweeping the radiometer detector over an object in the area of interest to obtain radiometric data of the object;

distributing the radiometric data equally over the antenna pattern to construct an image using the location data;

averaging the radiometric data when the image overlaps an earlier image; and displaying an image using averaged radiometric data.

23. The method of claim 22, further comprising the step of:

repeating the sweeping step to refine the image.

24. The method of claim 1, wherein said step of displaying the image comprises:

displaying visual swaths representing the radiometric image data corresponding to portions of the area of interest over which the radiometer detector is swept.

25. The method of claim 1, wherein said step of detecting an object in a portion of the area of interest comprises:

automatically detecting an object in a portion of the area of interest.

26. The method of claim 1, wherein said step of detecting an object in a portion of the area of interest comprises:

manually detecting an object in a portion of the area of interest.

27. The method of claim 2, further comprising:

detecting an object in the area of interest.

28. The method of claim 27, further comprising:

repeatedly sweeping the detector over the object to obtain radiometer data.

29. The method of claim 28, wherein said step of processing the radiometer data and the location data to construct an image further comprises:

normalizing the radiometer data over a cartesian grid representing the area of interest.

30. The method of claim 28, wherein the detector includes a sensor having a gain pattern, and wherein said step of processing the radiometer data and the location data to construct an image further comprises:

dividing the area of interest into a grid composed of bins;

distributing the radiometer data across a kernel representing a gain pattern of the detector superimposed on the grid bins; and averaging the radiometer data distributed in each bin with radiometer data previously distributed in each bin.

31. The system of claim 11, wherein the data processor divides an area of interest into a cartesian grid composed of bins.

32. The system of claim 31, wherein the antenna horn has a known gain pattern, and wherein said data processor distributes the samples of radiometric data to the bins according to the known gain pattern and the location information.

33. The system of claim 31, wherein the data processor distributes the samples of radiometric data to the bins and averages the samples of radiometric data assigned to each bin with samples of radiometric data already assigned to each respective bin.

* * * * *